United States Patent [19]

Deschapelles et al.

[11] Patent Number: 4,486,509

[45] Date of Patent: Dec. 4, 1984

[54] ROLLING INGOT

[75] Inventors: Jorge B. Deschapelles, Ravenswood; Mark J. Haiar, Washington, both of W. Va.

[73] Assignee: Kaiser Aluminum & Chemical Corporation, Oakland, Calif.

[21] Appl. No.: 348,393

[22] Filed: Feb. 12, 1982

[51] Int. Cl.[3] ..... B22D 7/00

[52] U.S. Cl. ..... 428/582; 428/577; 428/599; 164/DIG. 6

[58] Field of Search ..... 428/577, 580, 581, 583, 428/584, 585, 599; D15/144; 249/174; 164/DIG. 6

[56] References Cited

U.S. PATENT DOCUMENTS

| | | | |
|---|---|---|---|
| 321,658 | 7/1885 | Sweet | 428/583 |
| 1,031,000 | 7/1912 | Higgin | 428/583 |
| 1,643,241 | 9/1927 | Gathmann | 428/585 |
| 2,282,463 | 5/1942 | Dornin | 428/599 |
| 2,514,850 | 7/1950 | Dornin | 428/580 |
| 2,871,532 | 2/1959 | Gathmann | 249/174 |

FOREIGN PATENT DOCUMENTS

| | | | |
|---|---|---|---|
| 47-492 | 11/1972 | Japan | 249/174 |
| 317688 | 8/1929 | United Kingdom | 249/174 |
| 431949 | 11/1974 | U.S.S.R. | 249/174 |

*Primary Examiner*—L. Dewayne Rutledge
*Assistant Examiner*—John J. Zimmerman
*Attorney, Agent, or Firm*—John S. Rhoades

[57] ABSTRACT

An improved ingot shape which when rolled to sheet or plate does not form laminated edges which must be trimmed. The narrow faces of the generally rectangularly shaped ingot have recesses along the length of the upper and lower portions thereof. The land area between the two recesses on each narrow face extends outwardly beyond the top and bottom edges of the ingot.

3 Claims, 9 Drawing Figures

ROLLING INGOT

BACKGROUND OF THE INVENTION

This invention relates to an improved shape for large rolling ingot used in the manufacture of sheet and plate, particularly sheet and plate from light metals such as aluminum and aluminum alloys.

In the conventional manufacture of sheet and plate, a large DC cast rolling ingot having a generally rectangularly shaped transverse cross section is heated to a hot rolling or other elevated temperature and passed several times through a breakdown mill to produce an elongated slab of about 1-2 inches thick. The slab is then passed through a multistand mill while still at an elevated temperature to form a sheet or plate of desired thickness.

When conventional DC cast thick ingots are rolled at elevated temperatures, quite frequently laminations form at the longitudinal edges of the rolled product and these laminations can cause edge cracks during subsequent rolling which must be trimmed. During the initial hot rolling reductions, the top and bottom sections of the ingot are worked extensively, while the center section remains relatively undeformed. During the initial deformation there is a slight lateral spreading and relatively large longitudinal extension of the metal in the top and bottom sections of the ingot. However, because essentially no direct thickness reductions occur to the center section of the ingot during these initial stages of rolling, there is no lateral spreading of the ingot in this section. Indeed, there is usually a slight reduction in the width of the center section of the ingot due to the elongation of the center section caused by the extensions of the top and bottom sections during the early stages of rolling. In the later stages of rolling, the rolling reductions penetrate into the undeformed center section of the ingot, and this section also begins to spread due to these reductions, so that for the remainder of the hot rolling operation the lateral spread of the top center and bottom sections of the ingot are essentially the same. However, because the upper and lower sections of the ingot experience more lateral spread than the center section of the ingot, the over-hanging edges of the top and bottom sections are rolled closer together to ultimately form the laminations previously discussed. The metal in the laminated edges of the rolled slab is heavily worked and under tension and during subsequent rolling is subjected to excessive stresses which cause the formation of cracks. For an excellent discussion of this phenomenon, see *Mechanical Metallurgy,* 2nd ed. by G. B. Dieter, (1976), pp. 623-628. See, also, article by D. S. Wright et al., in *Metals Technology,* May 1981, pp. 180-89.

Prior procedures used to minimize edge cracking comprise rolling the edges to extend them and thereby relieve some of the stresses. While these procedures have been effective for the most part in reducing edge cracking, they generate considerable equipment and maintenance problems because one or more sets of vertically oriented rolls must be provided in the mill train. Moreover, edgerolling required on a conventional ingot also increases the amount of liquated structure appearing on the edges of the final rolled surface which must be trimmed. On the latter point it should be noted that usually only the broad faces of the rolling ingot are scalped prior to rolling which removes the liquated structure which forms during casting. The liquated surface on the narrow faces is not removed so if it is rolled onto the surface at the edges it usually must be trimmed.

DESCRIPTION OF THE INVENTION

This invention is directed to an improved shape for elongated rolling ingot which minimizes edge laminations and the edge cracking which frequently results without the need for rolling the edges with vertical rolls. Moreover, by avoiding edge rolling, the amount of liquated structure appearing on the final rolled surface can be significantly reduced.

The generally rectangularly shaped ingot in accordance with the invention has opposed narrow and broad faces with the rolling occurring on the broad faces. Elongated recesses are provided along the lengths of the upper and lower portions of the narrow faces. The intermediate sections or land areas of the narrow faces, between the two elongated recesses, extend out beyond the longitudinal corners of the ingot which lie at the intersection of the narrow and broad faces. These land areas may be flat or curved. The curvature and overall shape of the upper and lower recessed sections in the narrow faces are empirically designed so that during the initial stages of rolling, when the top and bottom sections of the ingot spread laterally, the edges of these sections spread out uniformly to the edges of the essentially undeformed center section of the ingot. Thereafter, during the rolling process the intermediate section of the ingot is also deformed by the rolling and the entire thickness of the ingot is deformed more or less equally. In this manner the laminations which are formed are insignificant and the amount of edge cracks from such laminations is negligible. Moreover, there is little evidence of a liquated structure on the edge surface of the final product.

The recesses in the narrow faces of the ingots preferably have curved surfaces but angularly shaped planar surfaces will also be suitable. A lip should be provided along the longitudinal intersections between the narrow faces and broad faces of the ingot which overhang a portion of the adjacent recesses.

The ingots of the invention are preferably DC cast so care must be exercised in the design of the ingot to ensure that the intersections of ingot surfaces are well rounded, because sharp intersections tend to cause ingot cracking during casting.

Reference is made to the drawings which further illustrate the invention.

FIGS. 3*a–d* are cross sectional views illustrating the transverse cross sectional changes of a conventional ingot and the ingot of the invention as the ingots proceed through the rolling process at elevated temperatures.

Figure 4A:
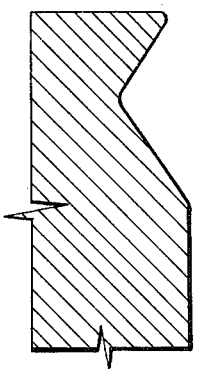
Figure 4B:
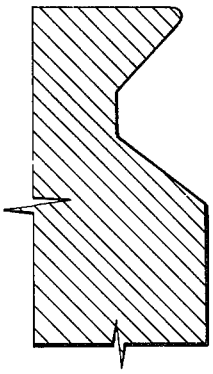
Figure 4C:
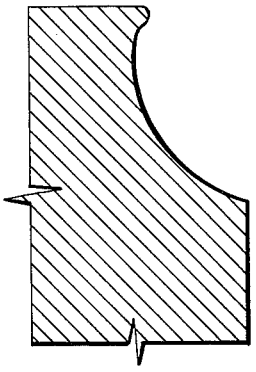

FIGS. 4*a–c* illustrate cross sectional views of various recess shapes which are suitable with the present invention.

Figure 1:
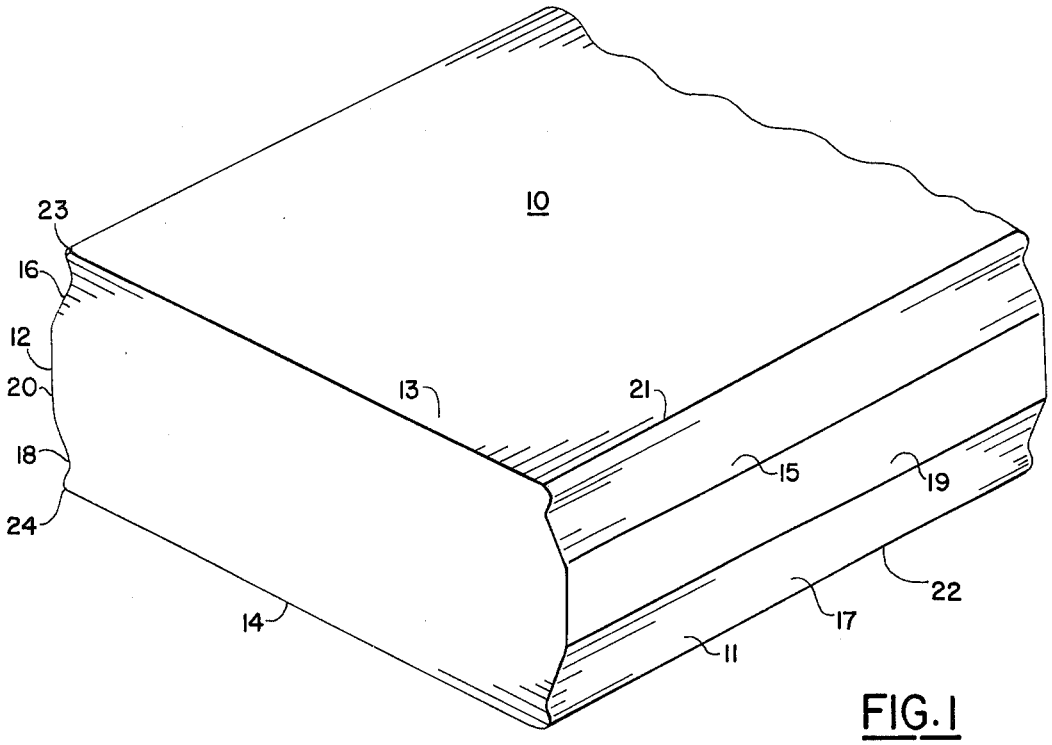
FIG. 1 is a perspective view of part of an ingot in accordance with the invention.

FIG. 1 illustrates in perspective a portion of an ingot 10, shaped in accordance with the invention. The ingot 10 has opposing narrow faces 11 and 12 and relatively flat opposing broad faces 13 and 14. The narrow faces 11 and 12 are provided with elongated recesses 15 and 16 and 17 and 18 which extend along the upper and lower sections, respectively, of the ingot 10. The intermediate surfaces 19 and 20 which are disposed on the narrow faces 11 and 12 between the recesses 15–18 extend out beyond the lips 21–24 at the intersection between the narrow faces 11 and 12 and the broad faces 13 and 14. Surfaces 19 and 20 are shown as flat but they may be curved.

Figure 2:
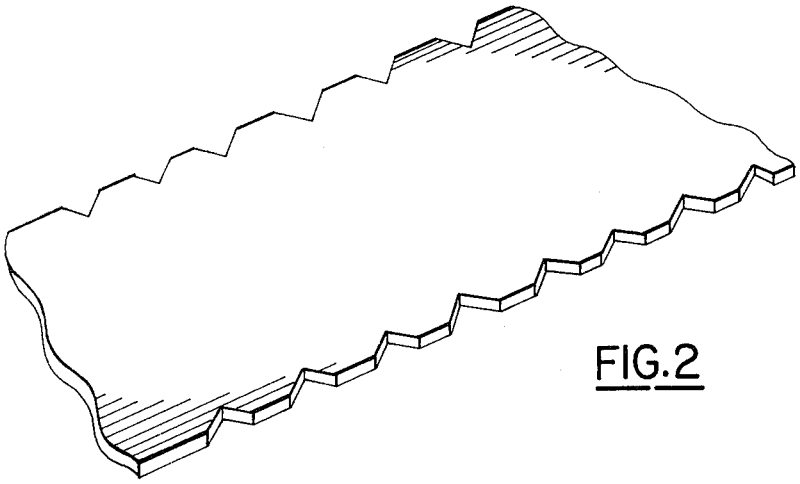
FIG. 2 is a schematic perspective view of a hot rolled sheet exhibiting edge cracking characteristic of conventional practices.

FIG. 2 represents in a simplified manner a partial perspective view of a sheet or plate product having edge cracking which results from the laminated edge formed from conventionally shaped ingots.

Figure 3A:
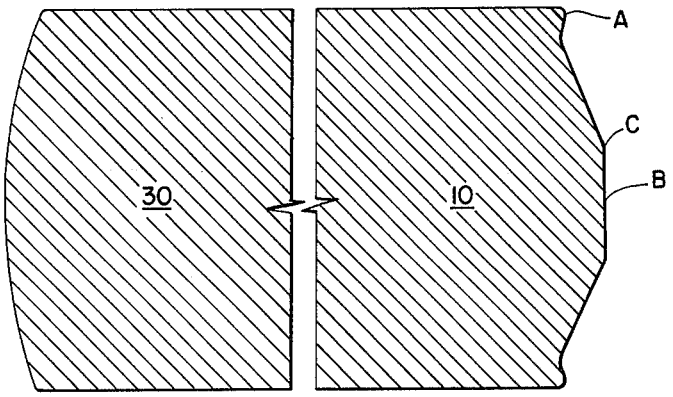
Figure 3B:
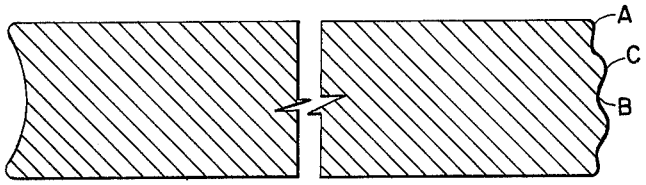
Figure 3C:
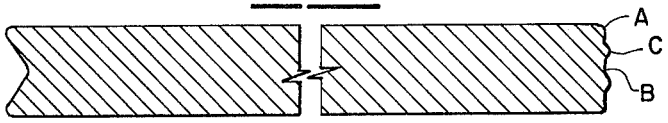
Figure 3D:
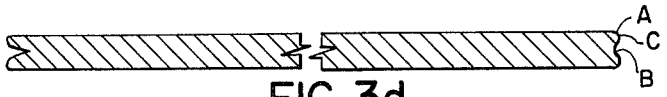

FIGS. 3*a–d* illustrate the thickness reductions of a conventional ingot 30 (on the left) and an ingot 10 of the invention (on the right) during the rolling process. FIG. 3*a* shows the partial cross sections of original ingots, FIG. 3*b* shows the partial cross sections after rolling reductions of about 60%, FIG. 3*c* shows the partial cross sections after rolling reductions of about 80% and FIG. 3*d* shows the partial cross sections after rolling reductions of about 95%. As evident from FIG. 3*b* the upper and lower edges (Point A) of the ingots have extended outwardly a significant amount due to the spreading of the upper and lower sections during the initial rolling. On the other hand, the width of the ingot at the center section has decreased by a significant amount. In FIG. 3*d* the width of the center section of the ingots has increased due to the spreading caused by rolling reductions. Most notable, however, is the extensive lamination evident with the conventional ingot and the lack of such lamination with the ingot of the invention.

In rolling ingots as shown in FIGS. 3*a–d* width measurements were taken on the top surface (points A) and midpoints of both ingots (points B) and at the edges of the land or center section 19 (point C) at the start and at various stages of rolling. The ingot widths which were measured before rolling and after rolling reductions of 60, 80 and 95% are given in the table below.

| Figure | Thickness (inches) | Point Location | Width of Conventional Ingot(inches) | Width of Ingot of the Invention (inches) |
|---|---|---|---|---|
| 3a | 24 | A | 51.50 | 50.25 |
| | | B | 54.50 | 54.75 |
| | | C | | 54.75 |
| 3b | 1O | A | 55.63 | 53.50 |
| | | B | 53.63 | 53.75 |
| | | C | | 54.25 |
| 3c | 5 | A | 55.88 | 53.75 |
| | | B | 53.88 | 53.50 |
| | | C | | 54.00 |
| 3d | 1.5 | A | 56.25 | 53.75 |
| | | B | 55.13 | 53.88 |
| | | C | | 54.25 |

With both ingots, the initial rolling reductions cause the top and bottom sections of the ingots to spread laterally, whereas, the center section contracts laterally due to the longitudinal extension of the center section by the elongation of the upper and lower sections of the ingot. The thickness of the center section is not directly reduced by rolling until most of the reduction has been effected. However, after a thickness reduction of about 60–90% (i.e., to a thickness of 10–5 inches) the center section begins to be deformed directly by the rolling process causing the center section to spread laterally along with the upper and lower sections. At this point, up to two inches or more width differential exists in the slab between the top and bottom sections and the center thereof. This is to be compared with the width differential of about 0.25 inch with the ingot of the invention. Subsequent rolling ameliorates these differentials in the slabs from both ingots but it does not eliminate the lamination which is formed with the conventional ingot during the initial rolling stages.

During the rolling of the ingot of the present invention, these large width differentials are not formed and as a result little or no edge laminations occur. Note that in the above table the final maximum differential between the initial and final widths for the ingot design of the present invention was a negative 0.5 inch whereas with the conventional ingot the final width differential was a positive 1.12 inch. Furthermore, point A on the conventional ingot has spread 1.25" more than the ingot of the invention, and this spread gives rise to extra liquated surface during edge rolling which must be trimmed off.

It is obvious that various modifications and improvements can be made to the invention without departing from the spirit thereof and the scope of the appended claims.

We claim:

1. An elongated DC cast aluminum ingot having a generally rectangular cross-section and having first and second opposed narrow longitudinal faces and first and second opposed broad longitudinal faces, with the broad faces, and being considerably wider than the narrow faces, and being suitable for rolling into sheet or plate products, the improvement comprising:

said first and second broad longitudinal faces being relatively flat;

said narrow longitudinal faces each having an upper and a lower section and an intermediate surface, and being provided with elongated recesses extending along the lengths of said upper and lower sections of the narrow longitudinal faces and with elongated land areas at said intermediate surfaces between the elongated recesses, the ingot width at the land areas being greater than the ingot width at the intersections of the broad and the narrow longitudinal faces of the ingot.

2. The ingot of claim 1 wherein the land area on each of the narrow faces is either flat or curved.

3. The ingot of claim 1 wherein a lip is provided at the intersection of the broad and narrow faces which overhangs a portion of the adjacent recess.

* * * * *